US007209091B2

(12) United States Patent
Schadler et al.

(10) Patent No.: US 7,209,091 B2
(45) Date of Patent: Apr. 24, 2007

(54) VERTICALLY POLARIZED PANEL ANTENNA SYSTEM AND METHOD

(75) Inventors: John L. Schadler, Raymond, ME (US); Andre J. Skalina, Portland, ME (US)

(73) Assignee: SPX Corporation, Charlotte, NC (US)

( * ) Notice: Subject to any disclaimer, the term of this patent is extended or adjusted under 35 U.S.C. 154(b) by 198 days.

(21) Appl. No.: 11/098,412

(22) Filed: Apr. 5, 2005

(65) Prior Publication Data

US 2006/0220976 A1 Oct. 5, 2006

(51) Int. Cl.
*H01Q 21/12* (2006.01)

(52) U.S. Cl. ..... 343/812; 343/810; 343/797

(58) Field of Classification Search ..... 343/810–820, 343/795, 797, 853, 846
See application file for complete search history.

(56) References Cited

U.S. PATENT DOCUMENTS 5,274,391 A 12/1993 Connolly ..... 343/820
5,936,590 A 8/1999 Funder ..... 343/795
6,034,649 A * 3/2000 Wilson et al. ..... 343/797
6,072,439 A * 6/2000 Ippolito et al. ..... 343/797
6,195,063 B1 * 2/2001 Gabriel et al. ..... 343/797
6,697,029 B2 2/2004 Teillet et al. ..... 343/797

OTHER PUBLICATIONS

D . . . DKK de OK. ,Dkk Denki Kogyo Co., Ltd., UHF 4 Dipole Antenna Panel, 1 page, no date.

* cited by examiner

*Primary Examiner*—Hoang V. Nguyen
*Assistant Examiner*—Ephrem Alemu
(74) *Attorney, Agent, or Firm*—Baker & Hostetler LLP

(57) ABSTRACT

A very inexpensive and on-site tunable design for a vertically polarized panel antenna system, suitable for the FCC digital broadcast 700 MHz range is provided. Bowtie-like shaped antennas having machine-stampable planar elements with an adjustable separation are configured with a stripline feed. The stipline feed enables easy feeding of doublet systems to allow the configuration of an array of vertically polarized antennas. The various components of the antenna system can be easily tuned, enabling rapid deployment and quick operation.

21 Claims, 5 Drawing Sheets

20

VERTICALLY POLARIZED PANEL ANTENNA SYSTEM AND METHOD

FIELD OF THE INVENTION

The present invention relates generally to broadcast antennas. More particularly, the present invention relates to vertically polarized panel antennas.

BACKGROUND OF THE INVENTION

The United States Federal Communications Commission's (FCC) auction of the 700 MHz spectrum has resulted in the shift of the applicable standard for television broadcast from National Television System Committee (NTSC) to digital broadcast and has placed significant efforts toward new products to fit the needs of the new license holders. Much of the newly formed 700 MHz band will be used for mobile data casting which will require a high volume, rapid deployment of broadcast equipment. It is understood that broadband solutions will include both horizontally polarized and vertically polarized panel antennas. However, there currently are no broadband vertically polarized panel antenna systems that allow for simple construction, lower cost, easy tuning and low wind load. Such simplicity and ease of tuning will be a competitive advantage for the purpose of mass production.

Therefore, there is a need in the broadcast community for systems and method which provide broadband solutions that are simply constructed, have lower costs, are relatively easy to tune and have low wind load attributes.

SUMMARY OF THE INVENTION

The foregoing needs are met, to a great extent, by the present invention, wherein in one aspect an apparatus is provided that in some embodiments a polarized antenna system having simple construction, low cost, easy tuning and low wind load features is provide.

In accordance with one embodiment of the present invention a linearly polarized adjustable dipole antenna is provided, comprising a first pair of substantially parallel and similarly oriented monopole elements, including a first common section, substantially perpendicular to and joining bases of the first set of monopole elements, including an edge and an adjustable source first contact point, and an adjustably attachable first support, a second pair of substantially parallel and similarly oriented monopole elements, including an orientation opposite to the first pair of monopole elements and displaced from the first pair of monopole elements, including a second common section, substantially perpendicular to and joining bases of the second pair of monopole elements, including a second edge and an adjustable source second contact point, and an adjustably attachable second support, wherein the first and second pair of monopole elements are substantially within a common plane and whose first and second edges are displaced from each other by a first gap to form a first set of dipole radiators, wherein the first set of dipole radiators are tunable by adjusting the first gap.

In accordance with another embodiment of the present invention, In accordance with one embodiment of the present invention a linearly polarized adjustable dipole antenna is provided, comprising a first pair of substantially parallel and similarly oriented monopole elements, including a first common section, substantially perpendicular to and joining bases of the first set of monopole elements, including an edge and an adjustable source first contact point, and an adjustably attachable first support, a second pair of substantially parallel and similarly oriented monopole elements, including an orientation opposite to the first pair of monopole elements and displaced from the first pair of monopole elements, including a second common section, substantially perpendicular to and joining bases of the second pair of monopole elements, including a second edge and an adjustable source second contact point, and an adjustably attachable second support, a third pair of substantially parallel and similarly oriented monopole elements, including a third common section, substantially perpendicular to and joining bases of the third pair of monopole elements, including a third edge and an adjustable source third contact point, and an adjustably attachable third support, a fourth pair of substantially parallel and similarly oriented monopole elements, including an orientation opposite to the third pair of monopole elements and displaced from the third pair of monopole elements, including a fourth common section, substantially perpendicular to and joining bases of the fourth pair of monopole elements, including a fourth edge and an adjustable source fourth contact point, and an adjustably attachable fourth support, wherein the first and second pair of monopole elements are substantially within a common plane and whose first and second edges are displaced from each other by a first gap to form a first set of dipole radiators, wherein the first set of dipole radiators are tunable by adjusting the first gap, wherein the third and fourth pairs of monopole elements are substantially within the common plane and whose third and fourth edges are displaced from each other by a second gap to form a second set of dipole radiators, wherein the second set of dipole radiators are tunable by adjusting the second gap and, wherein the stripline feed's trace is also coupled to the adjustable source third contact point and the ground connection is also coupled to the adjustable source fourth contact point to symmetrically feed the respective contact points.

In accordance with yet another embodiment of the present invention, a linearly polarized adjustable dipole antenna is provided, comprising a first and third pair of radiating means for radiating electromagnetic energy, the first pair of radiating means being substantially parallel and similarly oriented, including a first and third common means for electrically and mechanically joining bases of the first and third pair of radiating means, respectively, the first and third common means including a first and third edge, and an adjustable source first and third contact point, respectively, and a first and third supporting means for non-conductively supporting the respective radiating means, including an adjustable first and third contact point, a second and fourth pair of radiating means for radiating electromagnetic energy, the second and fourth pair of radiating means being substantially parallel and similarly oriented, including an orientation opposite to the first and third pair of radiating means and displaced from the first and third pair of radiating means, including a second and fourth common means for electrically and mechanically joining bases of the second and fourth pair of radiating means, including a second and fourth edge and an adjustable source second and fourth contact point, respectively, and a second and fourth supporting means for non-conductively supporting the respective radiating means, including an adjustable second and fourth contact point, wherein the first, second, third and fourth pair of radiating means are substantially within a common plane and whose first and second edges are displaced from each other by a first gap to form a first set of dipole radiators, and whose third and fourth edges are displaced from each other by a second gap to form a second set of dipole radiators, wherein the first and second set of dipole radiators are tunable by adjusting the first and second gaps, respectively.

In accordance with yet another embodiment of the present invention, a method for fabricating a linearly polarized adjustable dipole antenna is provided, comprising the steps of fabricating substantially parallel and similarly oriented monopole elements, including a common section which is substantially perpendicular to and joining bases of the monopole elements, each common section including an edge and an adjustable contact point, arranging pairs of the monopole elements in opposite orientation to a first pair of monopole elements to form a gap between the edges of the common sections, to form dipole radiators mounting a dielectric supports including an adjustable attachment to the monopole elements, attaching a ground plane, attaching a stripline to the ground plane with the stripline's trace symmetrically coupled to the adjustable contact points, and a ground connection from the ground plane symmetrically coupled to the adjustable contact points of opposing pairs of monopole elements.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
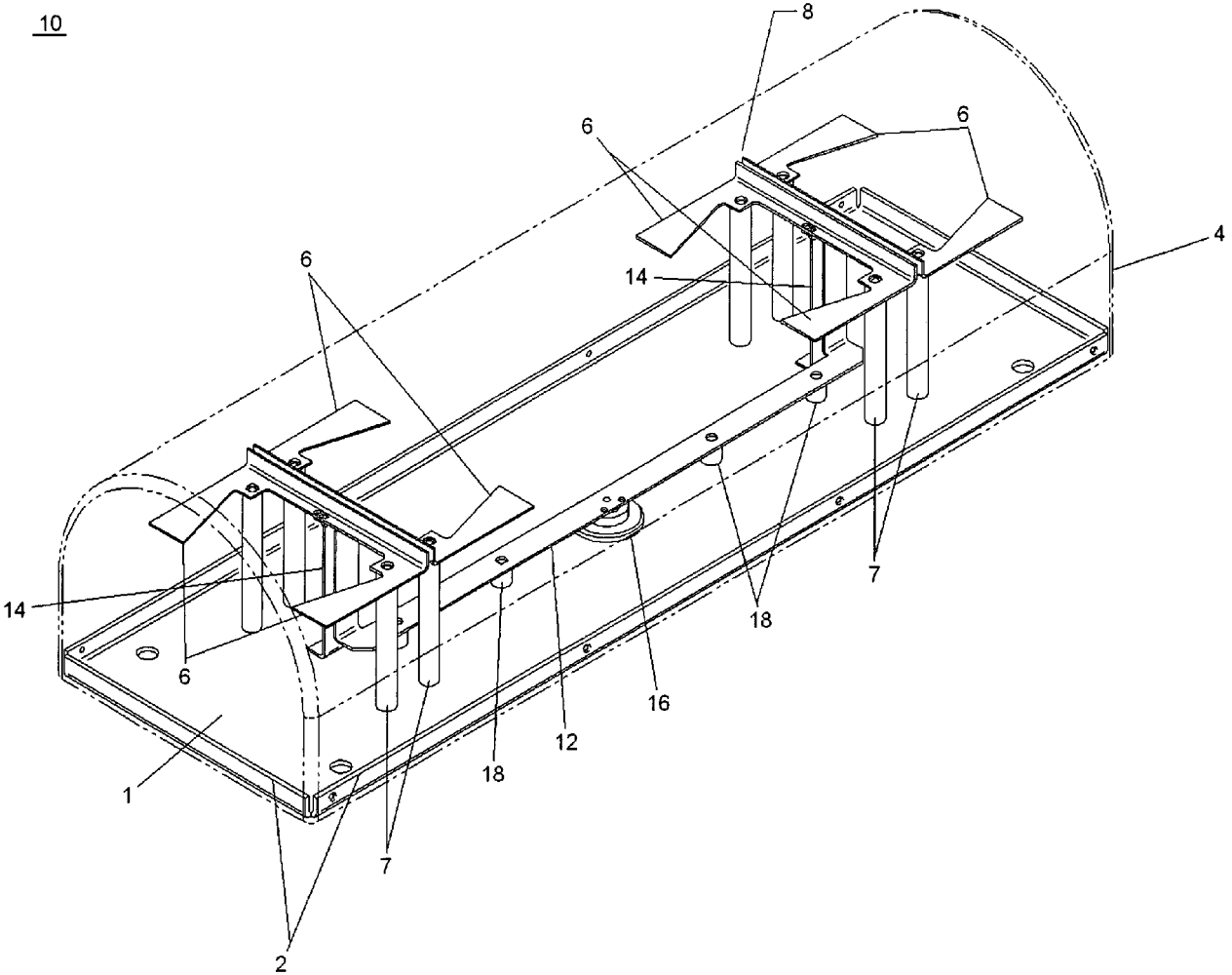
FIG. 1 is a perspective illustration of an exemplary embodiment of the invention.

The invention will now be described with reference to the drawing figures, in which like reference numerals refer to like parts throughout. An embodiment in accordance with the present invention provides a vertically polarized antenna system having simple construction, low cost, easy tuning and low wind load features. The exemplary embodiments described herein, accordingly, are well suited for digital broadcast television and other forms of broadcast signals that require relatively inexpensive polarized panel antenna systems.

FIG. 1 illustrates a perspective view 10 of an exemplary embodiment according to this invention with an outline of a radome 4 shield. The exemplary embodiment is shown with a conducting back panel 1 which may be solid in form, or semi-solid according to the operating wavelengths of the exemplary antenna system. The back panel 1 is shown configured with optional lips for facilitating the attachment of a non-conductive, electromagnetically transmissive antenna cover or radome 4. Of course, other forms of affixing a radome 4 to the exemplary embodiment may be used as desired. The back panel 1 is understood to operate as an electromagnetic field ground plane, but it is also understood to operate as a support structure to enable the securing of the dipole radiators 6 via non-conductive or dielectric supports 7.

The dipole radiators 6 are shown in FIG. 1 as being composed of pairs of "bowtie" shaped elements having an "upper" pair configuration (i.e., right hand side of FIG. 1) and a "lower" pair configuration (i.e., left hand side of FIG. 1). The tapered shape of the elements of the bowtie configuration enables an increase in the operating bandwidth of the dipole radiators 6 as compared to conventional non-tapered dipole radiators. In the exemplary embodiment described herein, the elements of the dipole radiators 6 are separated by approximately 5 inches. However, depending on design objectives, including frequency or beamwidth considerations, the separation can be adjusted without departing from the spirit and scope of the invention.

The set of dipole radiators 6 in each upper and lower pair is separated from its dual by a capacitive gap 8 whose separation distance between opposing surfaces of the dipole radiators 6 is adjustable. The gap 8 is augmented by a raised lip to form an increased surface area between the set of dipole radiators 6 for higher reactance sensitivity, as is well known in the plate capacitance equation $C=\epsilon A/d$, where C is the capacitance, $\epsilon$ is the permittivity, A is the surface area and d is the distance between opposing surfaces. In the exemplary embodiment described herein, a gap 8 distance of approximately 3/16 inches was determined to provide suitable capacitive coupling. Of course, other dimensions and surface or capacitance increasing schemes may be used according to design preferences.

The dipole radiators 6 in the exemplary embodiment are positioned substantially within a common horizontal plane that is displaced from the back panel 1 by approximately ¼ wavelength of the operating center frequency of the dipole radiators 6. Respective dipole radiators 6 of the upper and lower dipole radiators 6 pairs are complementarily driven by a stripline feed 12 and a ground plane feed 14 coupled to the back plane 1, to form two in-phase driven antennas. The stripline feed 12 symmetrically feeds the upper and lower dipole radiator 6 pairs and is excited by a symmetric input 16 contacting the stripline feed 12. The input 16 is preferably, but not necessarily, of a coaxial configuration and is coupled to the "rear" of the stripline feed 12 via an aperture in the back panel 1. It is understood, in this example, that the input's 16 excitation signal is coupled to the stripline feed 12, while the "ground" signal of the input 16 is coupled to the back plane 1. The stripline feed's 12 impedance and signal carrying capabilities are designed with effective transmission line characteristics for conveying the signals from the input 16 to the dipole radiators 6. It should be appreciated that while the stripline feed 12 is illustrated in FIG. 1 as utilizing an air gap, a non-air gap may be utilized according to design preferences. The separation distance between the stripline feed 12 and the back plane 1 is fixed by non-conductive dielectric supports 18 distributed across the length of the stripline feed 12.

Figure 2:
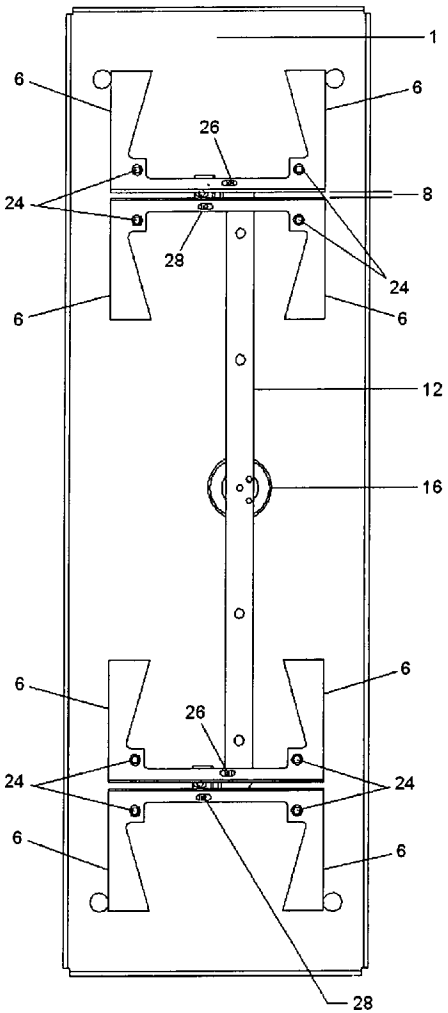
FIG. 2 is a top view illustration of an exemplary embodiment.

FIG. 2 is an illustration of a top view 20 of an exemplary embodiment of the antenna system of FIG. 1. The back plane 1 is illustrated in FIG. 2 as substantially rectangular solid surface. However, the back plane 1 can be of any configuration that provides ground plane characteristics for the wavelengths of interest. Thus, back plane 1 may be circular, for example, or replaced by a perforated metallic surface or discontinuous surface with voids having wavelength spacing sufficiently small enough to render the back plane 1 as an electromagnetic image surface. Each dipole radiator 6 is secured to its supporting member 7 (obstructed from view) via holes 24 and an appropriated designed screw or attachment means. The holes 24 are preferably oversized or elongated to enable horizontal adjustment of the dipole radiators 6 so as to provide a mode of adjustment for increasing or decreasing the size of the gap 8. The holes 24 facilitate screws or attachment means that are preferably non-metallic, however, metallic means may be used if they are sufficiently small with respect to the operating wavelengths. By use of a preferably non-metallic screw or locking mechanism which fixes the dipole 6 to the dielectric support 7, adjustment of the gap 8 can be made, for example, for tuning purposes.

It should be appreciated that the adjustment and securing function of the holes 24 may be replaced with alternative adjustment and securing schemes such as a sliding dielectric support 7 without departing from the spirit and scope of this invention. As such, a single dielectric support 7 may be used, having a sufficient enough width to span the holes 24 for a pair of dipole radiators 6. Accordingly, variations to effectuate the adjustability of the gap 8 may be accomplished by other means and techniques that are hereto known or later devised.

Coupling of the energy conveyed from the input coupler 16 via the stripline feed 12 to the respective dipole radiators 6 is accomplished through connection points 26, illustrated in FIG. 2 at a near midpoint of the dipole radiator 6 portion that spans the individual elements. To enable movement of the dipole radiators 6 during adjustment of the gap 8, the connection point 26 is also adjustable. However, since the connection point 26 is an electrical connection, it attached to the dipole radiators 6 via a metallic screw or similarly functioning metallic means, such as, for example, a sliding metallic contact. Analogous to the excitation signals conveyed by the connection points 26, the ground signals are similarly accomplished by connection points 28 at the "bottom" of each dipole radiator 6 of the pairs of dipole radiators 6. Of course, connecting the ground signal to the bottom dipole radiator 6 of a dipole radiator 6 pair and connecting the excitation signal to the top dipole radiator 6 of a dipole radiator 6 pair is relative, and maybe reversed according to design preference.

By suitably configuring the holes 24, 26 and 28, the dipole radiators 6 can be moved in "shear" respect to each other perpendicularly along the major axis of the back plane 1. It should be appreciated that the holes 24, 26 and 28 may also be configured to enable off-axis movement. That is, the dipole radiators 6 can be moved in askance to the major axis of the back plane 1, for example, along a lateral plane in the minor axis of the back plane 1. Therefore, by having two lateral ranges of motion, several degrees of positioning are possible, and thus, enabling very simple and efficient tuning adjustments to the dipole radiators 6

It should also be appreciated that while the holes 26 and 28 are illustrated as being off-centered from the mid-point of the bridging sections of the dipole radiators 6, coupling of the signals from the stripline feed 12 and the ground 14 (obscured from view) may be achieved using a connection that is "centered" within the bridging portion of the dipole radiators 6. To enable this, the orientations of the vertical portions of the stripline feed 12 and the ground 14 may be adjusted to enable connection of the vertical portion of the stripline feed 12 and the ground 14 to the mid-point of the bridging portion of the dipole radiators 6. That is, the vertical portions thereof may be rotated about a vertical axis while retaining a uniform gap between the vertical portion of the stripline feed 12 and the ground 14. By rotating an orientation thereof, the coupling contact holes 26 and 28 can be moved to a more centered-like position within the bridging portion of the dipole radiators 6. Of course, as is apparent from the above description, one of ordinary skill in the art having understood this description, may make further modifications according to design preference without departing from the spirit and scope of this invention.

The stripline feed 12 is illustrated in FIG. 2 as a uniform strip line coupled to an input connector 16, preferably, but not necessarily, a DIN-connector. The stripline feed 12 is illustrated as primarily being composed of two sections, the first section being the elevated trace portion and its accompanying grounded back plane 1; and the second section being the vertically rising trace portion and its accompanying vertically rising ground portion 14 (obstructed from view) that contacts the dipole radiators 6 at the contact points 26 and 28, respectively, for each upper and lower dipole radiator 6 pair. Adjustment of the stripline feed 12 characteristics as well as its accompanying ground portions are within the purview of one of ordinary skill in art and can be made by any one or more of now known or future derived techniques to adjust the impedance, frequency response, etc. without departing from the spirit and scope of this invention. Accordingly, discussions regarding the particularities of stripline design are not discussed herein.

Figure 3:
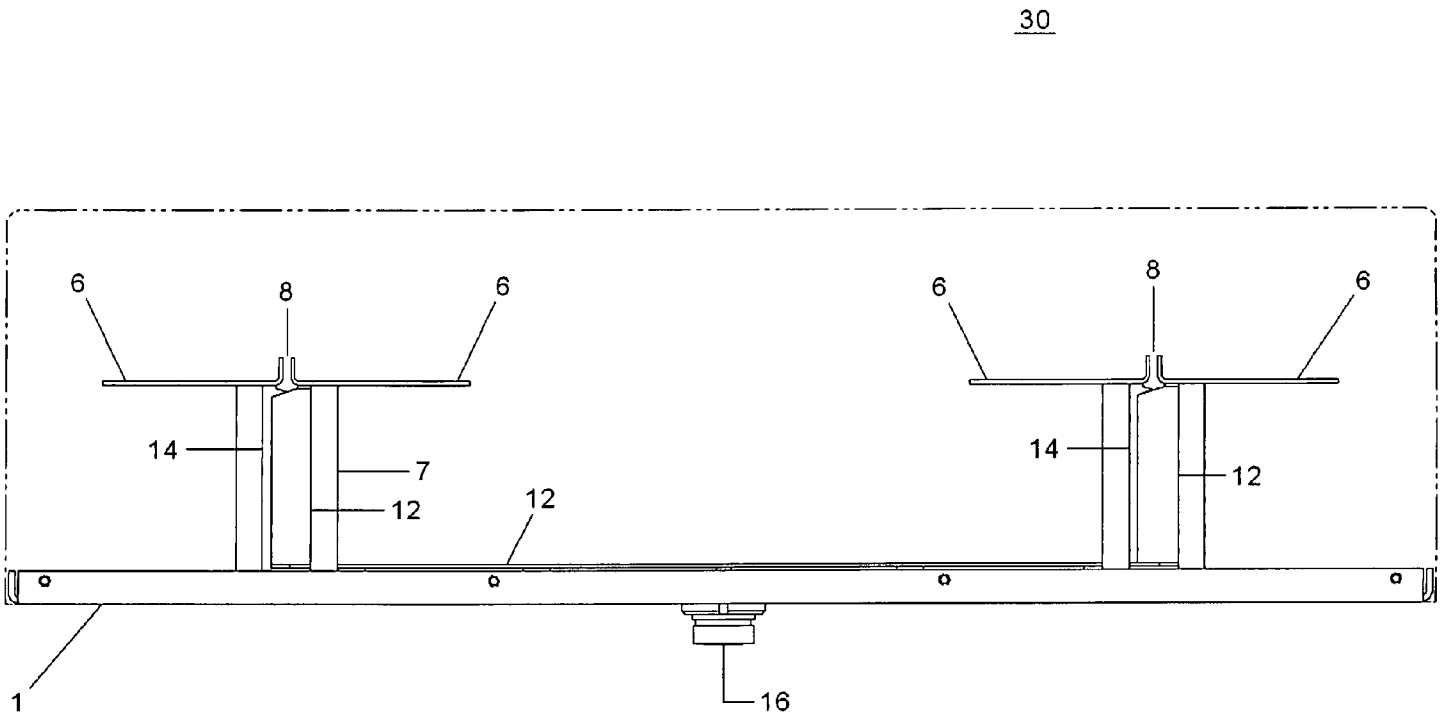
FIG. 3 is a side view illustration of an exemplary embodiment.

FIG. 3 is an illustration of a side view 30 of the exemplary embodiment shown in FIG. 2. The vertical displacement relationships between the various elements of the exemplary embodiment can be more easily seen in FIG. 3. For example, dielectric support members 7 are positioned below each dipole radiators 6 and each of the dipole radiators 6 are relatively planar with respect to each other and are separated from their opposite dipole radiator 6 by the gap 8. The side of the vertical arm portion of the stripline feed 12 is seen leading the vertical arm portion of the ground 14 with some overlap between the vertical portions of the stripline feed 12 and ground 14. The overlap arises from the fact that the vertical portion of the stripline feed 12 transitions from a "simple" stripline above a "large" ground plane configuration (e.g., the back plane 1) to a vertical stripline with a truncated ground plane (e.g., vertical portion of the ground 14). The overlap maintains the field structures of the stripline feed 12 to enable proper transmission of the currents. As such, the dimensions and spacing between the vertical portions of the stripline feed 12 and the ground 14 must be carefully attended to. In the exemplary embodiment described herein, a separation distance of approximately ¼ inches was found to be suitable for retaining the stripline's transmission characteristics for the frequencies of interest.

Of course, depending on the width of the stripline feed 12 trace, relative thickness, the frequencies of interest, etc., the separation distance may be ultimately found to be different. Therefore, modifications to the dimensions and spacings may be made without departing from the spirit and scope of this invention.

The lengths of the vertical portions of the stripline feed 12 and ground 14 are designed to be approximately ¼ wavelength of the main operating frequency, to permit the vertical portions to effectively operate as an impedance matching transformer between the impedances of the stripline feed 12 and the dipole radiators 6. Further manipulation of the impedance transformer capabilities can be accomplished by judicious adjustment of the width and thickness of the respective vertical portions as well as the lengths and separation thereof.

Figure 4:
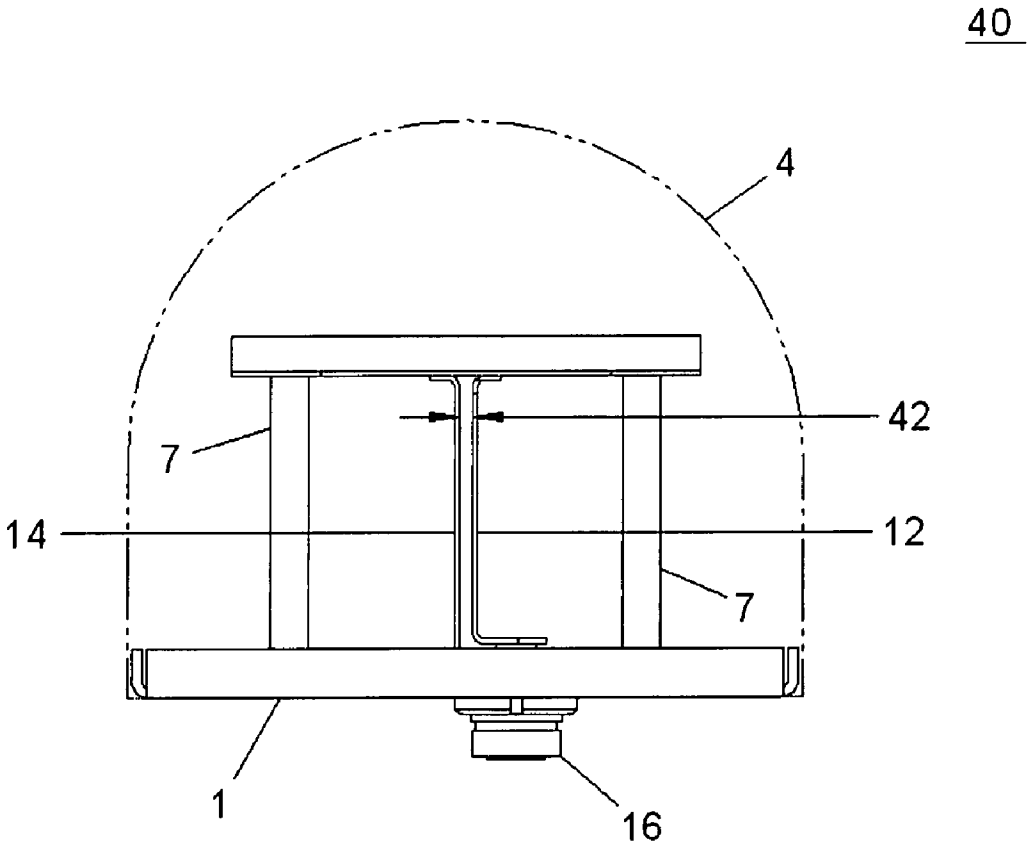
FIG. 4 is an end view illustration of an exemplary embodiment.

FIG. 4 is an illustration of an exemplary end view 40. As discussed above, the impedance matching of the stripline feed 12 to the dipole radiators 6 can be adjusted by increasing or decreasing the separation gap 42. It should be appreciated that while FIG. 4 illustrates a separation gap 42 being predominately constant along the vertical portions of the stripline feed 12 and ground portion 14, non-constant gaps 42 may be accommodated. For example, the vertical ground portion 14 may be non-perpendicular or at an angle with respect to the surface of the dipole radiators 6 and/or the back panel 1. Additionally, the dielectric or non-conducting supports 7 may also be at an angle to the surface of the dipole radiators 6 or the back plane 1.

The contour of the radome 4 is illustrated in FIG. 4 as a predominately arched-like shape, similar to that of a mailbox. In the exemplary embodiments described herein, a mailbox-like shaped radome 4 is utilized because it is well known in the art that a mailbox-like shaped radome affords a low wind resistance profile as compared to other shapes. Of course, any shape that is suitable may be used for the radome 4 and, therefore, the embodiments described herein may use other shapes without departing from the spirit and scope of this invention. A side profile of the "rear" of the input connector 16 is shown as a DIN-type connector, being offset from the main centerline of the back plane 1. It should be appreciated that while FIG. 4 illustrates an "off-centerline" DIN (and it's accompanying stripline feed 12), a centered configuration may be used by reversing the placement of the vertical ground portion 14 and/or shifting the contact points (obscured from view) of the stripline feed 12 and the vertical ground portion 14 with the dipole radiators 6.

Figure 5:
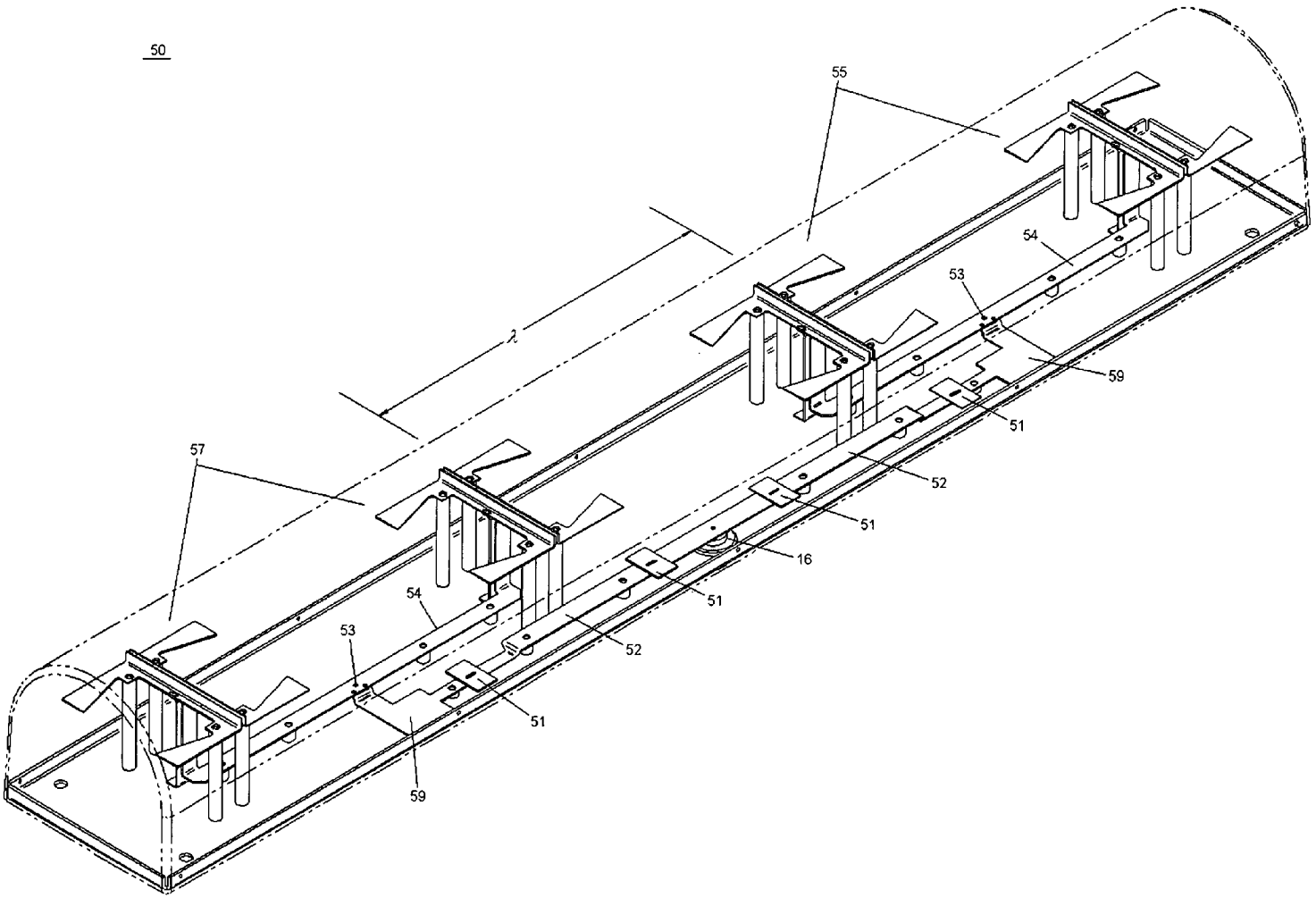
FIG. 5 is a perspective view illustration of an array of an exemplary embodiment.

FIG. 5 is an illustration of a single panel array 50 of exemplary antennas having a common input 16. The exemplary array 50 is composed of an upper antenna doublet 55 and a lower antenna doublet 57 displaced from each other by a distance λ, that corresponds substantially to a whole wavelength of the center frequency of the dipole radiators 6. For a 700 MHz system, the distance λ would be approximately 0.43 meters. Adjustment of the distance λ can also be made for beam forming and coupling purposes. Both the upper 55 and the lower 57 antenna doublets are fed from a main stripline line feed 52 coupled to the input 16, having a symmetrical branch connection point 53 which feeds secondary striplines feeds 54. The signals coupled to the main stripline feed 52 symmetrically travel to the secondary stripline feeds 54 via semi-rectangular impedance transformer sections 59. The impedance transformer sections 59 operate to smoothly transition the differing impedances between the secondary stripline feeds 54 and the main stripline feed 52. The impedance matching and tuning of the stripline feeds 52 and 54 can also be manipulated by tuning elements 51, shown distributed along the main stripline feed 52. While the impedance transformer sections 59 and tuning elements 51 are shown as being substantially rectangular, any shape that provides a transforming function may be used.

It should be appreciated that the planar aspects of the dipole radiators 6 used in the various exemplary embodiments described herein enable easy manufacturing using, for example, stamping or other mass production manufacturing processes. Since each of the dipole radiators 6 are accommodated with an adjustable gap 8, and the stripline feeds 12, 52, and 54 can be matched using tuning elements 51, the exemplary antennas enable post-factory tuning to be accomplished relatively easily at a site location. Thus, deviations from manufacturing tolerances in the antennas systems can be overcome by the simple adjustment mechanisms described herein. Further, it is well known that an antenna system's performance as measured and tuned in a manufacturing environment may significantly differ from the site conditions upon actual installation of the antenna system. As such, the adjustable features of the exemplary antenna systems described herein enable rapid and convenient on-site tuning of the antenna for optimal performance. Therefore, herethereto expensive methods for tuning conventional antennas systems can be mitigated, thus enabling the rapid and inexpensive deployment of exemplary vertically polarized panel antenna systems.

It should be appreciated that the collinear nature of the dipole radiators 6 provide for a polarization conformity. Accordingly, if the exemplary antenna systems are placed in a vertical orientation, then a vertical polarization will become the dominant polarization. Conversely, if the exemplary antennas systems are placed in a horizontal orientation, then a horizontal polarization will become the dominant polarization. Therefore, while the exemplary embodiments described are in the terms of a vertically polarized panel antenna system, they can be equally suited for a horizontally polarized operation.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A linearly polarized adjustable dipole antenna, comprising:

a first pair of substantially parallel and similarly oriented monopole elements, including:

a first common section, substantially perpendicular to and joining bases of the first set of monopole elements, including an edge and an adjustable source first contact point; and an adjustably attachable first support;

a second pair of substantially parallel and similarly oriented monopole elements, including an orientation opposite to the first pair of monopole elements and displaced from the first pair of monopole elements, including:

a second common section, substantially perpendicular to and joining bases of the second pair of monopole elements, including a second edge and an adjustable source second contact point; and an adjustably attachable second support, wherein the first and second pair of monopole elements are substantially within a common plane and whose first and second edges are displaced from each other by a first gap to form a first set of dipole radiators, wherein the first set of dipole radiators are tunable by adjusting the first gap.

2. The linearly polarized adjustable dipole antenna of claim 1, further comprising:

a ground plane approximately ¼ wavelength from the common plane.

3. The linearly polarized adjustable dipole antenna of claim 2, further comprising:

a stripline feed having a trace coupled to the adjustable source first contact point and a ground connection from the ground plane coupled to the adjustable source second contact point.

4. The linearly polarized adjustable dipole antenna of claim 3, further comprising:

a support between the stripline trace and the ground.

5. The linearly polarized adjustable dipole antenna of claim 1, wherein the adjustable source first and second contact points and the adjustably attachable first and second supports are accommodated by elongated holes.

6. The linearly polarized adjustable dipole antenna of claim 1, wherein the adjustable source first and second contact points and the adjustably attachable first and second supports are accommodated by slotted holes.

7. The linearly polarized adjustable dipole antenna of claim 1, wherein the first and second edges are defined by a lip of the first and second common sections.

8. The linearly polarized adjustable dipole antenna of claim 1, wherein capacitance from the first gap varies substantially as a linear function of first gap distance.

9. The linearly polarized adjustable dipole antenna of claim 1, wherein the first and second monopole elements are tapered.

10. The linearly polarized adjustable dipole antenna of claim 3, further comprising:

a third pair of substantially parallel and similarly oriented monopole elements, including:

a third common section, substantially perpendicular to and joining bases of the third pair of monopole elements, including a third edge and an adjustable source third contact point; and an adjustably attachable third support;

a fourth pair of substantially parallel and similarly oriented monopole elements, including an orientation opposite to the third pair of monopole elements and displaced from the third pair of monopole elements, including:

a fourth common section, substantially perpendicular to and joining bases of the fourth pair of monopole elements, including a fourth edge and an adjustable source fourth contact point; and an adjustably attachable fourth support, wherein the third and fourth pairs of monopole elements are substantially within the common plane and whose third and fourth edges are displaced from each other by a second gap to form a second set of dipole radiators, wherein the second set of dipole radiators are tunable by adjusting the second gap and, wherein the stripline feed's trace is also coupled to the adjustable source third contact point and the ground connection is also coupled to the adjustable source fourth contact point to symmetrically feed the respective contact points.

11. The linearly polarized adjustable dipole antenna of claim 10, wherein the third and fourth monopole elements are tapered.

12. The linearly polarized adjustable dipole antenna of claim 10, wherein the dipole radiators form a bow-tie antenna.

13. The linearly polarized adjustable dipole antenna of claim 10, wherein the gaps of the first and second dipole radiators are approximately one wavelength apart from each other.

14. The linearly polarized adjustable dipole antenna of claim 11, wherein the dipole radiators are configured for 700 MHz operation.

15. The linearly polarized adjustable dipole antenna of claim 11, wherein the dipole radiators are configured for FCC-compliant digital broadcast operation.

16. A linearly polarized adjustable dipole antenna, comprising:

a first and third pair of radiating means for radiating electromagnetic energy, the first pair of radiating means being substantially parallel and similarly oriented, including:

a first and third common means for electrically and mechanically joining bases of the first and third pair of radiating means, respectively, the first and third common means including a first and third edge, and an adjustable source first and third contact point, respectively; and a first and third supporting means for non-conductively supporting the respective radiating means, including an adjustable first and third contact point;

a second and fourth pair of radiating means for radiating electromagnetic energy, the second and fourth pair of radiating means being substantially parallel and similarly oriented, including an orientation opposite to the first and third pair of radiating means and displaced from the first and third pair of radiating means, including:

a second and fourth common means for electrically and mechanically joining bases of the second and fourth pair of radiating means, including a second and fourth edge and an adjustable source second and fourth contact point, respectively; and a second and fourth supporting means for non-conductively supporting the respective radiating means, including an adjustable second and fourth contact point, wherein the first, second, third and fourth pair of radiating means are substantially within a common plane and whose first and second edges are displaced from each other by a first gap to form a first set of dipole radiators, and whose third and fourth edges are displaced from each other by a second gap to form a second set of dipole radiators, wherein the first and second set of dipole radiators are tunable by adjusting the first and second gaps, respectively.

17. The linearly polarized adjustable dipole antenna of claim 16, further comprising:

a grounding means for generating an electromagnetic ground plane approximately ¼ wavelength from the common plane.

18. The linearly polarized adjustable dipole antenna of claim 17, further comprising:

a transmission line means for transmitting electrical signals, the transmission line means being coupled to the adjustable source first and third contact point, and to the adjustable source second and fourth contact point.

19. A method for fabricating a linearly polarized adjustable dipole antenna, comprising the steps of:

fabricating substantially parallel and similarly oriented monopole elements, including a common section which is substantially perpendicular to and joining bases of the monopole elements, each common section including an edge and an adjustable contact point;

arranging pairs of the monopole elements in opposite orientation to a first pair of monopole elements to form a gap between the edges of the common sections, to form dipole radiators;

mounting a dielectric supports including an adjustable attachment to the monopole elements;

attaching a ground plane;

attaching a stripline to the ground plane with the stripline's trace symmetrically coupled to the adjustable contact points, and a ground connection from the ground plane symmetrically coupled to the adjustable contact points of opposing pairs of monopole elements.

20. The method for fabricating a linearly polarized adjustable dipole antenna of claim 19, further comprising the step of:

adjusting the gaps between opposing pairs of monopole elements to tune the antenna.

21. The method for fabricating a linearly polarized adjustable dipole antenna of claim 19, wherein the fabricating of the monopole elements is by a machine stamping process.

* * * * *

UNITED STATES PATENT AND TRADEMARK OFFICE

CERTIFICATE OF CORRECTION

PATENT NO. : 7,209,091 B2
APPLICATION NO. : 11/098412
DATED : April 24, 2007
INVENTOR(S) : John L. Schadler et al.

It is certified that error appears in the above-identified patent and that said Letters Patent is hereby corrected as shown below:

Item (57), Abstract
Line 6, please replace “stipline” with --stripline--.

Signed and Sealed this

Twenty-sixth Day of June, 2007

JON W. DUDAS
*Director of the United States Patent and Trademark Office*